United States Patent [19]

Dallamore

[11] 4,067,811

[45] Jan. 10, 1978

[54] APPARATUS FOR SEPARATING FLOATING POLLUTANTS

[76] Inventor: Larry Evan Dallamore, 6 Caragana Ave., Sherwood Park, Alberta, Canada

[21] Appl. No.: 680,189

[22] Filed: Apr. 26, 1976

[51] Int. Cl.[2] ..... E02B 15/04

[52] U.S. Cl. ..... 210/242 S; 210/DIG. 25

[58] Field of Search ..... 210/84, 104, 242 R, 210/532 R, DIG. 25, 242 S

[56] References Cited

U.S. PATENT DOCUMENTS

| | | | |
|---|---|---|---|
| 2,769,546 | 11/1956 | Fontein | 210/84 |
| 3,348,690 | 10/1967 | Cornelissen | 210/DIG. 25 |
| 3,656,619 | 4/1972 | Ryan et al. | 210/DIG. 25 |
| 3,656,623 | 4/1972 | Quase | 210/242 S |
| 3,701,429 | 10/1972 | Schell | 210/242 S |
| 3,722,689 | 3/1973 | Markel et al. | 210/DIG. 25 |
| 3,753,496 | 8/1973 | Boyd | 210/242 S |
| 3,800,951 | 4/1974 | Mourlon et al. | 210/242 S |
| 3,853,767 | 12/1974 | Mohn | 210/242 S |

FOREIGN PATENT DOCUMENTS

| | | | |
|---|---|---|---|
| 2,253,378 | 6/1975 | France | 210/242 S |
| 1,274,387 | 5/1972 | United Kingdom | 210/242 S |

*Primary Examiner*—Theodore A. Granger

[57] ABSTRACT

Apparatus for separating floating pollutants from a body of water. A vessel has an opening in at least one side to define an inlet for the pollutant and the top water layer. There are means within the vessel to impart a whirlpool motion to the admitted pollutant and water in which the pollutant forms a thickened upper layer. A nozzle is positioned at about the center of the means to impart whirlpool motion. The nozzle projects upwardly. A separator is positioned beneath the nozzle whereby floating pollutants can be removed from the top of the separator and water from the bottom of the separator.

6 Claims, 4 Drawing Figures

APPARATUS FOR SEPARATING FLOATING POLLUTANTS

FIELD OF INVENTION

This invention relates to an apparatus for separating floating pollutants, particularly oil, from a body of water.

DESCRIPTION OF PRIOR ART

The relatively recent problem of massive oil spills, stemming principally from the use of so-called "super tankers" but also from the increased consumption of oil with consequent increased tanker traffic, has not been adequately solved.

A number of schemes have been advanced but, in the main, they are only effective on a small scale, for example for the cleaning of docks and beaches. It is believed that a desirable solution to the problem would be a sea-going vessel able to gather a substantial portion of the spilled oil. At present many of the vessels used to clean oil spills are relatively small and are not sea-going.

SUMMARY OF INVENTION

The present invention seeks to provide a sea-going apparatus for separating floating pollutants from a body of water and particularly a vessel for use in clearing oil spills that is able to clear and recover large volumes of oil from the sea.

Accordingly, the present invention is an apparatus for separating floating pollutants from a body of water comprising a vessel, an opening in at least one side of the vessel to define an inlet for the pollutant and the top water layer, means within the vessel to impart a whirlpool motion to the admitted pollutant and water in which the pollutant forms a thickened upper layer, a nozzle positioned about the center of the means to impart whirlpool motion and projecting upwardly, and a separator positioned beneath the nozzle whereby floating pollutants can be removed from the top of the separator and water from the bottom of the separator.

In a preferred embodiment the separator is a tank having an opening in its top. A first conduit leads from the opening towards the bottom of the tank but stops short of the bottom of the tank to define a space to permit water in the conduit to pass from the conduit through the space and into the tank. The pollutant passes from the top of the conduit to a space other than that occupied by the water.

BRIEF DESCRIPTION OF DRAWINGS

An embodiment of the invention is illustrated, by way of example, in the accompanying drawings in which.

DESCRIPTION OF PREFERRED EMBODIMENT

Figure 1:
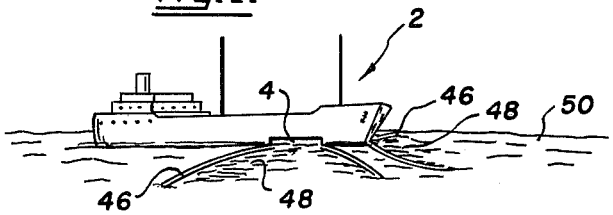
FIG. 1 is a general view of a ship according to the present invention.
Figure 4:
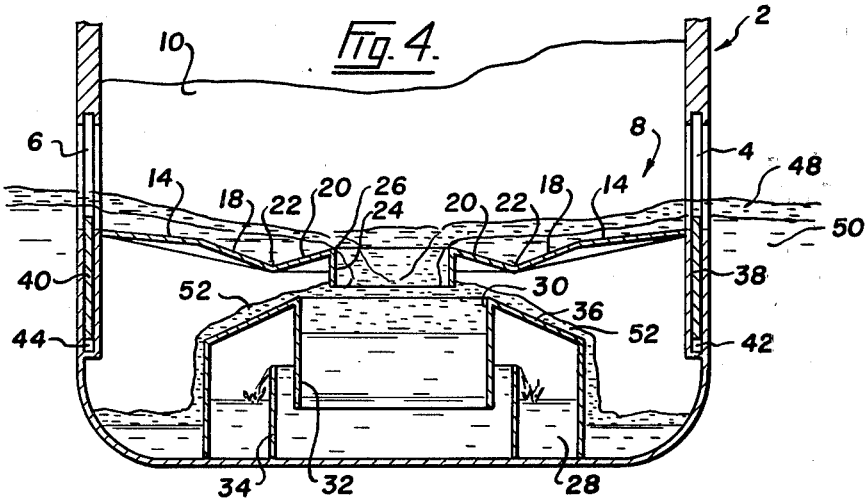
FIG. 4 is a general section of the ship in FIG. 1.

FIG. 1 illustrates an apparatus for separating floating pollutants from a body of water comprising a vessel in the form of a ship generally indicated at 2. The ship is provided with a first opening 4 in its starboard side. As shown in FIG. 4 the ship also has a second opening 6 in the port side. This second opening 6 is positioned in the port side of the vessel 2 in a position corresponding to the first opening 4 in the starboard side.

Figure 2:
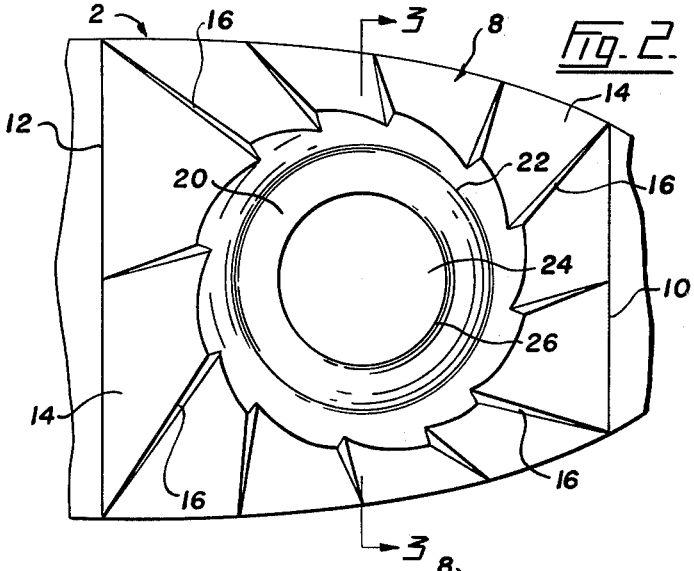
FIG. 2 is a plan view of a part of the ship of FIG. 1.

As indicated particularly in FIG. 2 the ship 2 is formed with a compartment 8 defined by the port and starboard sides of the ship, by a forward bulkhead 10 and a stern bulkhead 12. Although not shown in FIG. 2 the first and second openings 4 and 6 are positioned in each side of the compartment 8.

Figure 3:
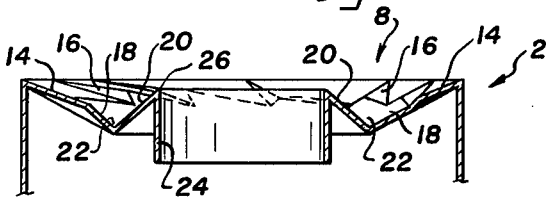
FIG. 3 is a section along the line 3—3 of FIG. 2.

The compartment 8 is provided with means to impart a whirlpool motion to pollutants and water admitted into the compartment 8 through the first and second openings 4 and 6. As indicated in FIGS. 2 to 4 the means to impart the whirlpool motion comprises a plurality of inclined surfaces. The first inclined surface 14 is inclined downwardly from the openings 4 and 6. The surface 14 is formed with projecting ribs 16 to control the direction of the flow although these ribs are not essential. In the illustrated embodiment of FIG. 2, the direction of the fluid flow will be clockwise and the ribs 16 provide an upstanding surface that reduces any tendency of the liquid to travel in a reverse, or counterclockwise, direction.

The first inclined surface 14 is followed by a second inclined surface 18. The second inclined surface is sloped at a steeper angle than the first inclined surface 14 and, with a third, upwardly inclined surface 20 forms a channel generally indicated at 22 which facilitates the formation of a thickened upper layer of pollutant.

At about the center of the whirlpool area is a nozzle 24 whose upper level 26 is above the base of the channel 22.

As indicated in FIG. 4, beneath the compartment 8 is a tank 28. The tank 28 has an opening 30 in its top and a conduit 32 leading from the opening 30 towards the bottom of the tank 28, which in the illustrated embodiment, is also the bottom of the ship 2. However, the conduit 32 stops short of the bottom of the tank. In the illustrated embodiment a second conduit 34 extends upwardly from the base of the tank to surround the first conduit 32.

The top of the tank 28 is formed with a sloped top 36 to facilitate the flow across the top of the tank.

FIG. 4 also illustrates that the openings 4 and 6 are closeable by water tight doors 38 and 40 respectively. Again as indicated in FIG. 4 these doors are received in compartments 42 and 44 when they are opened.

In use the illustrated embodiment of the present invention works as follows.

First, selected portions of the oil slick are surrounded by booms 46. These booms are located at one of their ends forward of an opening 4 or 6 and the other of their ends, at the stern of the openings 4 or 6. The booms may be positioned by a small boat carried on the ship 2. When the booms 46 are in position the ship 2 is stopped and doors 38 and 40 opened. The lower edges of the openings 4 and 6 are slightly below water level so that, as indicated in FIG. 4, an oil layer 48 and the top layer of the water 50 enter the ship through the openings 4 and 6 in the sides of the ship. Inside the ship the oil and water enter compartment 8 and move quickly down the first inclined surface 14, down the second inclined surface 18 and into the channel 22 formed by the second inclined surface 18 and the third inclined surface 20 to form a whirlpool. The ribs 16 restrict and control the direction of the flow to assist in imparting the whirlpool motion. As the channel 22 fills up the effect of the whirlpool motion is to concentrate or build up a thickened layer of pollutant in the whirlpool. Thus, a first or preliminary separation of the pollutant from the water is carried out. The oil and water pass through the nozzle 24 and pass through the opening 30 in the tank 28. The pollutant from the layer 48 forms a flow 52 of oil over the upper surface 36 of the tank 28. The water, being of greater specific gravity, passes to the bottom of the conduit 32 into the conduit 34. From there is passes over the upper edge of the conduit 34 into the interior of the tank 28. That tank may extend the full length of the ship. Although not shown, the tank is provided with pump means that ensure that the water fed into the tank 28 by the separating action of the whirlpool motion and of the separator nozzle 24 can be pumped back into the sea.

The oil flow 52 passes into the main body of the ship over the sloped top 36 of the tank 28. It is stored there or may be pumped back to an attendent tanker.

Although not illustrated in the drawings, the hold of the ship may be provided with heaters to warm and thus thin the oil and facilitate its flow.

Further, in a preferred embodiment there may be provided liquid level controls in the part of the tank 28 outside the conduit 34. The liquid level control can be used to control pumps that remove the water from the interior of the tank 28. Similarly it is desirable to position a liquid level control just above the base of the conduit 32. This maintains a certain minimum amount of water within the conduit 32.

Once the oil has been removed from within the boom 46, the booms may be gathered in and repositioned in a further part of the oil slick.

It will be appreciated that the present invention uses a substantial proportion of the hold of the ship 2 to gather the oil from an oil slick. Thus one ship 2 can handle major oil slicks with the minimum number of attendant ships. For most oil slicks one ship 2 will be sufficient. However, if the full load of a supertanker should be spilled then the ship 2 can have a number of attendant vessels into which the ship 2 can empty its oil tanks when they are filled. It is not necessary for the ship 2 to leave the site of the spill.

I claim:

1. An apparatus for separating floating pollutants from a body of water comprising:

a self propelled boat;

a compartment in the boat having a base;

an opening in at least one side of the boat to define an inlet for the pollutant and the top water layer into said compartment;

a water tight door to closed the opening;

a nozzle at about the centre of the compartment providing an outlet from the compartment downwardly;

said base of the compartment being formed of a first surface inclined downwardly from the side of the compartment towards the nozzle and a second surface extending downwardly from the nozzle to meet the first surface;

a channel defined where the first and second surfaces meet;

projecting ribs formed on the first surface to impart unidirectional, whirlpool motion to the pollutants and water admitted to the compartment through the opening;

a tank below the base of the compartment having an opening aligned with but spaced from the nozzle in the compartment;

a first conduit leading from the opening towards the base of the tank but stopping short of the bottom of the tank to define a space to permit water in the conduit to pass from the conduit through the space and into the tank, the pollutant passing from the top of the conduit to a space other than that occupied by the water whereby water and the floating pollutant are separated.

2. Apparatus as claimed in claim 1 in which the top of the tank is sloped to facilitate flow of the pollutant.

3. Apparatus as claimed in claim 1 including a second conduit extending upwardly from the base of the tank to surround the first conduit and define a space between the first and second conduit through which water can pass.

4. Apparatus as claimed in claim 3 including a liquid level control in the tank to control the maximum level of water in the tank.

5. Apparatus as claimed in claim 1 and provided with a liquid level control adjacent the base of the first conduit to ensure that a certain minimum amount of liquid is maintained in the conduit.

6. Apparatus as claimed in claim 1 having openings in each side of the vessel adjacent the bow.

* * * * *